US009324194B2

(12) United States Patent
Pham

(10) Patent No.: US 9,324,194 B2
(45) Date of Patent: Apr. 26, 2016

(54) METHOD AND SYSTEM FOR DATABASE COMPILATION ON A REMOTE ELECTRONIC DEVICE

(71) Applicant: Innova Electronics, Inc., Irvine, CA (US)

(72) Inventor: Phuong Pham, Fountain Valley, CA (US)

(73) Assignee: Innova Electronics, Inc., Irvine, CA (US)

( * ) Notice: Subject to any disclaimer, the term of this patent is extended or adjusted under 35 U.S.C. 154(b) by 47 days.

(21) Appl. No.: 13/914,797

(22) Filed: Jun. 11, 2013

(65) Prior Publication Data

US 2014/0365064 A1 Dec. 11, 2014

(51) Int. Cl.
*G07C 5/00* (2006.01)
*G07C 5/08* (2006.01)

(52) U.S. Cl.
CPC ..... *G07C 5/008* (2013.01); *G07C 5/0808* (2013.01); *G07C 2205/02* (2013.01)

(58) Field of Classification Search
CPC .. G07C 5/008; G07C 5/0808; G07C 9/00571; G07C 2205/02; G07C 5/006; G07C 5/0841; G07C 5/085; B60L 11/1846; G05B 23/0272; G05B 23/0278
See application file for complete search history.

(56) References Cited

U.S. PATENT DOCUMENTS

D334,560 S 4/1993 Wilson
5,347,211 A 9/1994 Jakubowski
D377,622 S 1/1997 Chen
5,635,841 A 6/1997 Taylor
5,758,300 A 5/1998 Abe
5,767,681 A 6/1998 Huang
5,809,437 A 9/1998 Breed
5,859,628 A 1/1999 Ross et al.
5,884,202 A 3/1999 Arjomand
6,000,413 A 12/1999 Chen
6,055,468 A 4/2000 Kaman et al.
6,094,609 A 7/2000 Arjomand
6,169,943 B1 1/2001 Simon et al.
6,225,898 B1 5/2001 Kamiya et al.
6,263,268 B1 7/2001 Nathanson
6,272,402 B1 * 8/2001 Kelwaski ..... 701/1
6,389,337 B1 5/2002 Kolls
6,438,471 B1 8/2002 Katagishi et al.

(Continued)

OTHER PUBLICATIONS diagnostic_Merriam.pdf (Diagnostic | Definition of diagnostic by Merriam-Webster, Nov. 24, 2015, Merriam-Webster, http://www.merriam-webster.com/dictionary/diagnostic, pp. 1-4).*

*Primary Examiner* — Bao Long T Nguyen
(74) *Attorney, Agent, or Firm* — Stetina Brunda Garred & Brucker

(57) ABSTRACT

A system and method of customizing a data retrieval and storage device for communication with a specific vehicle after the device is initially connected to the vehicle. The system includes a master database having communication information arranged by vehicle specific information, and an automotive scan tool having an incomplete set of preloaded communication information stored thereon. The automotive scan tool is configured to retrieve an electronic VIN from the vehicle and upload the electronic VIN to the master database. After receiving the electronic VIN, the master database identifies the specific communication information associated with the vehicle and communicates such information to the automotive scan tool to compliment the preloaded communication information.

23 Claims, 2 Drawing Sheets

(56) References Cited

U.S. PATENT DOCUMENTS

| | | | | |
|---|---|---|---|---|
| 6,499,385 | B2 | 12/2002 | Protti | |
| 6,535,112 | B1 | 3/2003 | Rothshink | |
| 6,587,768 | B2 | 7/2003 | Chene et al. | |
| 6,611,740 | B2 | 8/2003 | Lowrey et al. | |
| 6,650,318 | B1 | 11/2003 | Arnon | |
| 6,677,854 | B2 | 1/2004 | Dix | |
| 6,732,031 | B1 | 5/2004 | Lightner et al. | |
| 6,807,469 | B2 | 10/2004 | Funkhouser et al. | |
| 6,836,708 | B2 | 12/2004 | Tripathi | |
| 6,847,916 | B1 | 1/2005 | Ying | |
| 6,868,369 | B2 | 3/2005 | Huang | |
| 6,925,368 | B2 | 8/2005 | Funkhouser et al. | |
| 6,940,270 | B2 | 9/2005 | Chen | |
| D510,287 | S | 10/2005 | Chen | |
| 6,957,133 | B1 | 10/2005 | Hunt et al. | |
| 6,968,733 | B2 | 11/2005 | Andreasen | |
| 7,030,742 | B2 | 4/2006 | Treadway | |
| 7,085,680 | B2 | 8/2006 | Huang | |
| 7,116,216 | B2 | 10/2006 | Andreasen | |
| 7,209,813 | B2 | 4/2007 | Namaky | |
| RE39,619 | E | 5/2007 | Andreasen | |
| D545,223 | S | 6/2007 | Chen | |
| D558,621 | S | 1/2008 | Rich | |
| D559,137 | S | 1/2008 | Protti | |
| D560,129 | S | 1/2008 | Rich | |
| D560,527 | S | 1/2008 | Rich | |
| 7,325,775 | B2 | 2/2008 | Chen | |
| D563,249 | S | 3/2008 | Chen | |
| 7,363,149 | B2 | 4/2008 | Klausner et al. | |
| D569,280 | S | 5/2008 | Chen | |
| 7,376,497 | B2 | 5/2008 | Chen | |
| D571,241 | S | 6/2008 | Andreasen | |
| 7,437,227 | B2 | 10/2008 | Andreasen | |
| D581,822 | S | 12/2008 | Madison | |
| 7,463,959 | B2 | 12/2008 | Namaky | |
| 7,464,000 | B2 | 12/2008 | Huang | |
| D590,387 | S | 4/2009 | Chen | |
| 7,520,668 | B2 | 4/2009 | Chen | |
| RE40,798 | E | 6/2009 | Chen | |
| RE40,799 | E | 6/2009 | Chen | |
| 7,603,293 | B2 | 10/2009 | Chen | |
| 7,620,484 | B1 * | 11/2009 | Chen | 701/31.5 |
| 7,627,406 | B2 | 12/2009 | Wang et al. | |
| D610,586 | S | 2/2010 | Chen | |
| 7,734,287 | B2 | 6/2010 | Ying | |
| 7,734,390 | B2 | 6/2010 | Chen | |
| 7,751,953 | B2 | 7/2010 | Namaky | |
| D624,446 | S | 9/2010 | Chen | |
| D624,838 | S | 10/2010 | Chen | |
| D625,209 | S | 10/2010 | Chen | |
| D625,210 | S | 10/2010 | Chen | |
| D625,634 | S | 10/2010 | Chen | |
| 7,904,219 | B1 | 3/2011 | Lowrey et al. | |
| 7,974,750 | B2 | 7/2011 | Namaky | |
| 8,019,503 | B2 | 9/2011 | Andreasen | |
| 8,024,083 | B2 | 9/2011 | Chen | |
| D646,188 | S | 10/2011 | Chen | |
| D646,599 | S | 10/2011 | Chen | |
| 8,032,419 | B2 | 10/2011 | Chen | |
| 8,032,878 | B2 * | 10/2011 | Nakagaki | 717/168 |
| 8,068,951 | B2 | 11/2011 | Chen et al. | |
| 8,095,261 | B2 * | 1/2012 | Howell et al. | 701/29.1 |
| 8,135,506 | B2 * | 3/2012 | Hansen et al. | 701/31.4 |
| 8,180,515 | B2 | 5/2012 | Namaky | |
| 8,195,231 | B2 | 6/2012 | Ring | |
| 8,301,329 | B2 | 10/2012 | Andreasen | |
| 8,306,687 | B2 | 11/2012 | Chen | |
| 8,370,018 | B2 | 2/2013 | Andreasen et al. | |
| 2003/0171111 | A1 | 9/2003 | Clark | |
| 2004/0110472 | A1 | 6/2004 | Witkowski | |
| 2007/0005204 | A1 * | 1/2007 | Yamamoto et al. | 701/35 |
| 2007/0296559 | A1 | 12/2007 | Fehr | |
| 2008/0119981 | A1 | 5/2008 | Chen | |
| 2008/0177438 | A1 * | 7/2008 | Chen et al. | 701/33 |
| 2009/0216401 | A1 * | 8/2009 | Underdal et al. | 701/35 |
| 2009/0259358 | A1 * | 10/2009 | Andreasen | 701/33 |
| 2009/0276115 | A1 * | 11/2009 | Chen | 701/32 |
| 2009/0299900 | A1 * | 12/2009 | Chen | 705/40 |
| 2010/0138701 | A1 * | 6/2010 | Costantino | 714/49 |
| 2011/0184784 | A1 * | 7/2011 | Rudow et al. | 705/7.38 |
| 2011/0224866 | A1 | 9/2011 | Chen | |
| 2011/0264322 | A1 | 10/2011 | Chen | |
| 2012/0010775 | A1 | 1/2012 | Chen | |
| 2012/0053778 | A1 * | 3/2012 | Colvin et al. | 701/29.4 |
| 2012/0215398 | A1 | 8/2012 | Chen | |
| 2012/0215400 | A1 | 8/2012 | Namaky | |
| 2013/0204485 | A1 * | 8/2013 | Chen et al. | 701/29.6 |
| 2014/0121888 | A1 * | 5/2014 | Guo et al. | 701/31.4 |
| 2014/0195098 | A1 * | 7/2014 | Lorenz et al. | 701/29.3 |
| 2014/0316639 | A1 * | 10/2014 | Braswell | 701/29.6 |

* cited by examiner

METHOD AND SYSTEM FOR DATABASE COMPILATION ON A REMOTE ELECTRONIC DEVICE

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field of the Invention

The present invention relates generally to customization of an automotive scan tool, and more specifically to remote customization of the scan tool based on an electronic VIN associated with the vehicle, wherein the remote customization is achieved via long range communication.

2. Description of the Related Art

Over time, vehicles have evolved from having relatively basic electrical components, into sophisticated and complex electro-mechanical systems. A standard vehicle manufactured in compliance with today's governing standards, generally includes a host of digital systems typically in communication with a central computer. The digital systems are associated with several different operational aspects of the vehicle, and as such, the digital systems generate an abundance of data during operation of the vehicle.

The operational data generated by the vehicle is useful to a wide range of industries, including the automotive repair industry and the insurance industry. The automotive repair industry may generally use the data for purposes of diagnosing potential problems with the vehicle, while the insurance industry may use the data to determine the driving habits of their customers.

Retrieval of the data is typically achieved through communication with the central computer. Most vehicles include a communications connector port, typically located near the steering wheel, for retrieving the data from the central computer. Furthermore, several devices have been developed for retrieving such data, such as automotive scan tools. An exemplary scan tool is the 3040 CanOBD2® Scan Tool developed by Innova Electronics Corp., owner of the present invention.

Although very basic communications with the central computer may be achieved through one of only a handful of protocols, achieving more detailed communications, e.g., with vehicle component devices, typically requires various protocols, translations, definitions which are specific to the year, make, model, or engine type of the vehicle. In this regard, identification of the protocols, translations and definitions associated with the vehicle typically requires identification of the year, make, model and/or engine type of the vehicle.

In view of the vehicle-specific information generally required for communicating with the vehicle devices, several prior art devices are customized before they are sold by having the essential vehicle-specific protocols, translations, definitions, etc., pre-loaded on the scan tool. In this regard, once the information is pre-loaded on the scan tool, usage of the scan tool with other vehicles may be precluded. Pre-loading the vehicle-specific information can make manufacturing a cumbersome endeavor. Furthermore, it is difficult for retailers to stock separate vehicle-specific tools.

In view of the foregoing, there is a need in the art for device for retrieving data from a vehicle's onboard computer and vehicle devices, wherein the device may be manufactured and loaded with universal/generic data, and configured after the sale of the device to customize the device to a specific vehicle.

BRIEF SUMMARY OF THE INVENTION

Various aspects of the present invention specifically addresses and alleviates the above-identified deficiencies in the art. Provided is a system and method of customizing a data retrieval and storage device for communication with a specific vehicle onboard computer and vehicle components after the device is initially connected to the vehicle. The system includes a master database having communication information arranged by vehicle specific information, and an automotive scan tool having an incomplete set of preloaded communication information stored thereon. The automotive scan tool is configured to retrieve an electronic VIN from the vehicle onboard computer, and upload the electronic VIN to the master database. After receiving the electronic VIN, the master database identifies the specific communication information associated with the vehicle components and communicates such information to the automotive scan tool to compliment the preloaded communication information.

A method of customizing a handheld automotive scan tool for use with an onboard vehicle computer, the method includes providing the handheld automotive scan tool which includes a storage module, and a long-range communication module in operative communication with the storage module. The automotive scan tool is configured to retrieve an electronic vehicle identification number (VIN) from the onboard vehicle computer when the automotive scan tool is in operative communication with the onboard vehicle computer. The method further includes storing a first set of communication information on the storage module. An electronic VIN is received from the handheld automotive scan tool and a second set of communication information associated with the electronic VIN received from the scan tool and complimentary to the first set of communication information is determined. The method additionally includes communicating the second set of communication information associated with the electronic VIN to the automotive scan tool to enhance the capability of the automotive scan tool to communicate with the onboard vehicle computer.

The method may additionally include decoding the electronic VIN to determine the year, make and model associated with the electronic VIN. The decoding step may be performed remotely from the automotive scan tool. The step of determining a second set of communication information may include determining a second set of communication information associated with the year, make and model associated with the electronic VIN.

The method may additionally comprise the step of compiling a master database including vehicle communication information matched with vehicle identification information, wherein the vehicle communication information includes the first set of communication information and at least one second set of communication information.

The automotive scan tool may be configured to autonomously generate a request for the electronic VIN in response to establishing a communication link between the automotive scan tool and the onboard vehicle computer. The determining step may be performed autonomously in response to receipt of the electronic VIN from the automotive scan tool. The communicating step may be performed autonomously in response to receipt of the electronic VIN from the automotive scan tool.

The second set of communication information may include information necessary for communicating with vehicle components or instructional commands for at least one of the vehicle onboard computer or vehicle components. The first set of communication information and the second set of communication information may include the totality of communication information needed by the scan tool to request vehicle operational information from the onboard computer.

According to another embodiment, there is provided a system for remote customization of a handheld automotive scan tool configured for communicating with an onboard vehicle computer. The system includes a master database including vehicle communication information matched with vehicle identification information. The vehicle communication information includes a first set of communication information and at least one second set of communication information. The system further includes an automotive scan tool having a storage module, and a long-range communication module in operative communication with the storage module and operatively connectable with the master database, wherein the storage module includes the first set of communication stored thereon. The automotive scan tool is configured to retrieve an electronic vehicle identification number (VIN) from the onboard vehicle computer and communicate the electronic VIN to the master database via the long-range communication module. The master database is configured to determine the at least one second set of communication information associated with the electronic VIN and communicate the determined at least one second set of communication information associated with the electronic VIN to the automotive scan tool.

The present invention is best understood by reference to the following detailed description when read in conjunction with the accompanying drawings.

BRIEF DESCRIPTION OF THE DRAWINGS

These as well as other features of the present invention will become more apparent upon reference to the drawings wherein.

Common reference numerals are used throughout the drawings and detailed description to indicate like elements.

DETAILED DESCRIPTION OF THE INVENTION

Figure 1:
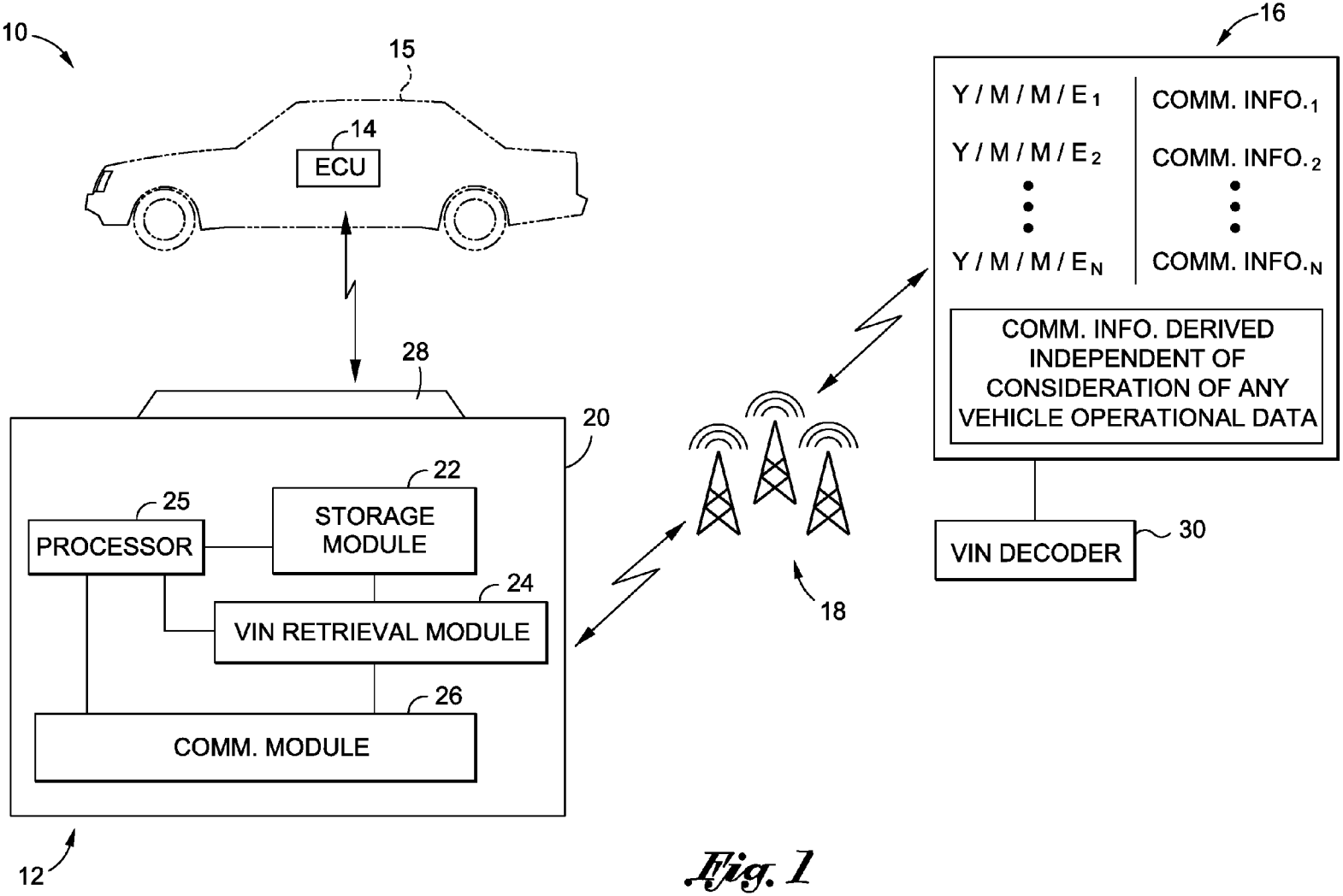
FIG. 1 is a schematic view of a system for remotely customizing an automotive scan tool according to one embodiment of the present invention.
Figure 2:
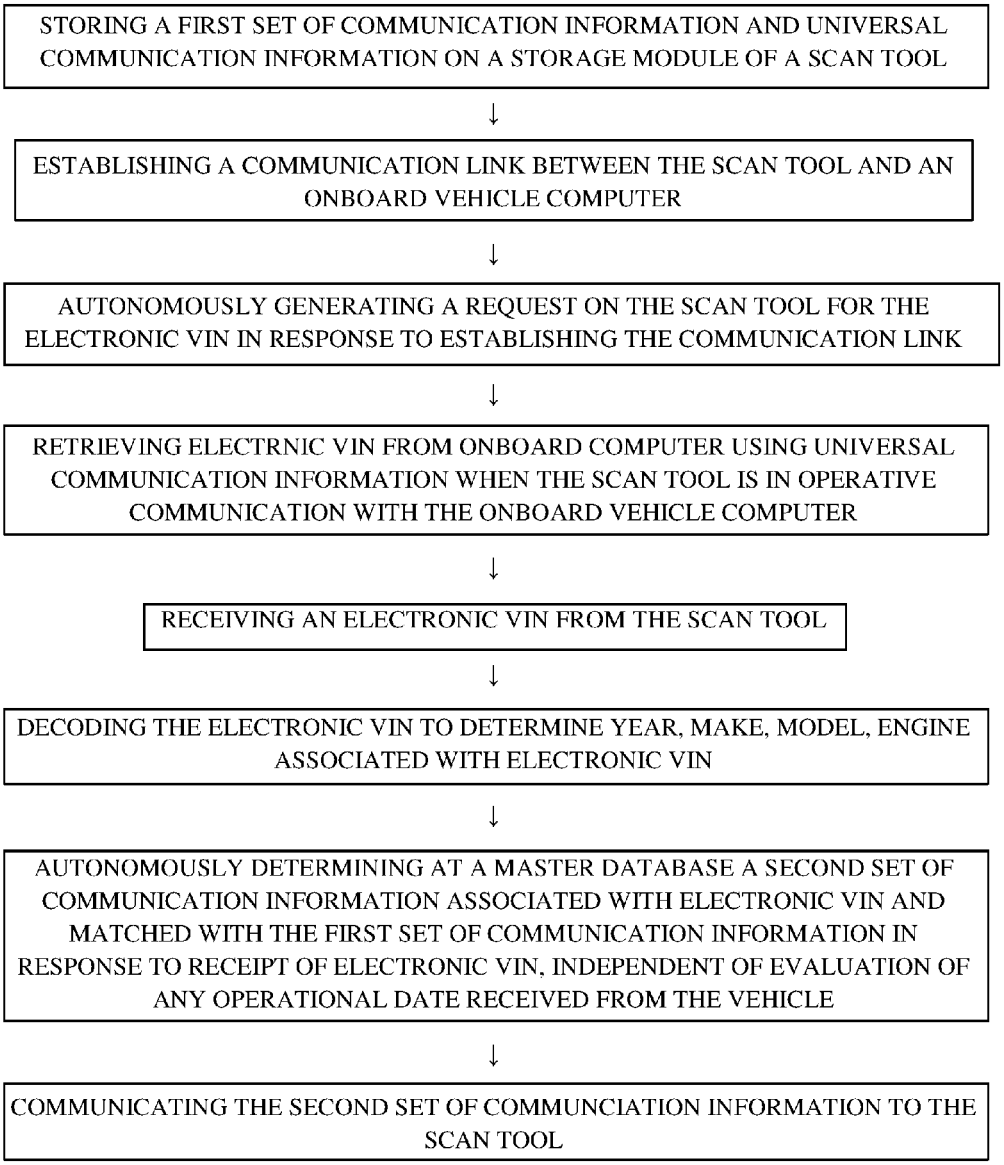
FIG. 2 is a flow chart associated with a method according to one embodiment of the present invention.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Referring now to the drawings, wherein the showings are for the purposes of illustrating a preferred embodiment of the present invention only, and are not for the purposes of limiting the same, there is depicted a system 10 for remotely customizing an automotive scan tool 12 to allow the scan tool 12 to communicate with an onboard vehicle computer 14. The system 10 generally allows for a two-step customization process wherein the first step includes storing generic or universal information on the scan tool 12 during manufacture of the tool 12 (or shortly thereafter), while the second step includes communicating customization information via a communications network 18, wherein the customization information is specific to the user's vehicle after the tool 12 is connected to the vehicle. The customization information may include communication protocols, definitions, translations, command instructions, licensed data, etc., collectively referred to herein as "communication information," that are specific or uniquely required for performing "higher level" communication with the user's vehicle. In this regard, the higher level communication information is different from "lower level" communication information, such as basic or universal protocols, etc. used to retrieve an electronic VIN. Upon completion of the two-step download of information to the tool 12, the tool 12 is capable of communicating with the vehicle computer 14.

As will be described in more detail below, several aspects of the remote customization of the automotive scan tool 12 provide several benefits and advantages. For instance, due to a portion of the communication information already being present on the automotive scan tool 12 (e.g., from the "first step" information download), the amount of data communicated over the communications network 18 between the database 16 and scan tool 12 is reduced (e.g., the amount of data transmitted is less than the totality of the communication information ultimately stored on the automotive scan tool 12). The reduced amount of data communicated between the database 18 and the automotive scan tool 12 may minimize data charges or other communication fees associated with the communication of such data, as well as transmission times.

Another advantage associated with various aspects of the present invention is that the system and method of customizing the scan tool 12 may result in storing only the minimal amount of communication information necessary for communicating with the vehicle. Yet another benefit associated with aspects of the present invention is that the automotive scan tool 12 may be universal in nature prior to customization, which would allow the scan tool 12 to be marketed to a wide range of consumers. In other words, the manufacturer is not required to manufacture separate tools 12 for separate makes of vehicles, which results in a more simplified manufacturing and retail processes.

Various features of the system 10 are additionally directed to enhancing the security of the master database 16. Along these lines, by limiting transmission of data from the master database to only the necessary communication information required by the scan tool 12 for communicating with a particular vehicle, the system 10 provides a level of security for the database 16 because the entire database 16 is not copied onto each and every scan tool 12. Rather, only that portion of the database 16 necessary for allowing a specific scan tool 12 to communicate with a specific vehicle is transmitted from the database 16 to the scan tool 12.

The database 16 is a master database that includes communication information for a wide range of vehicles. In this regard, the database 16 includes all necessary information needed by the scan tool 12 to communicate with an onboard computer 14 for performing desired functionality. For instance, the functionality performed by the scan tool 12 may include retrieving vehicle performance/operational information (e.g., odometer readings, braking information, acceleration/deceleration information, engine startup/shut down information, etc.). For a more sophisticated scan tool 12, that is, a scan tool 12 configured to perform more functions, the amount of communication information necessary tends to increase. Therefore, the amount of communication information ultimately stored on the automotive scan tool 12 may vary and may be commensurate in scope with the level of functionality to be performed by the tool 12.

The communication information stored in the database 16 is arranged according to vehicle classification, such as year, make, model, and/or engine type. It is understood that the same communication information may have different meanings or associations with different vehicles. For instance, the same trouble code (e.g., P0123) may have a first definition associated therewith in connection with a first vehicle, and a second definition associated therewith in connection with a second vehicle.

The scan tool 12 includes a housing 20, a storage module 22, a VIN retrieval module 24, and a communication module 26, all in operative communication with a processor 25. The storage module 22 is used for storing the communication information necessary to communicate with the onboard computer 14, as well as for storage of information received from the onboard computer 14.

The VIN retrieval module 24 may include the lower level protocols necessary for retrieving the electronic VIN from the vehicle 15 upon connection of the tool 12 with the vehicle 15. According to one embodiment, the protocols may be polled until a response is received from the vehicle 15.

The communication module 26 is used to communicate with the remote master database 16. In this regard, the communications module 26 is used to communicate the electronic VIN from the scan tool 12 to the database 16, as well as to receive customized communication information from the database 16 during the customization process. The communication module 26 may be capable of long range communications to allow of download of communication information from the database 16. In this regard, the communications module 26 may be configured to communication over a cellular communication network (e.g., the communications module 26 may be a cellular modem), a local area network, WiFi, or other communication networks known by those skilled in the art.

The scan tool 12 additionally includes a vehicle connector 28 which is operatively connectable with the vehicle 15 to establish a communication link between the onboard computer and the scan tool 12. The vehicle connector 28 may be embodied so as to effectuate direct, wired communication between the scan tool 12 and vehicle computer 14, or alternatively embodied to facilitate wireless communication between the scan tool 12 and the vehicle computer 14.

During manufacture (e.g., before the sale) of the tool 12 to the consumer, a first set of high-level communication information is downloaded and stored on the storage module 22. This information by itself does not allow the scan tool 12 to communicate with the specific onboard computer 14 for performing prescribed functionality. For purposes of clarity, such high-level communication information is not needed to retrieve an electronic VIN, which can be retrieved using universal protocols that are separate from the high-level communication information. As such, additional communication information is needed before the automotive scan tool 12 can effectively communicate with the onboard computer 14 to perform its intended functions. For instance, the first set of communication information stored on the storage module 22 may include a listing of protocols, diagnostic trouble codes, translations, instructional commands, etc. by themselves, and does not include vehicle identifying information (e.g., the tool 12 does not know which portions of the first set of communication information is associated with the specific vehicle communicating with the tool 12). In other words, if those protocols, diagnostic trouble codes, translations, and instructional commands are not matched with the appropriate vehicle classification information (e.g., year, make, model, engine, etc.), such information may be too ambiguous for any practical usage. Thus, the first set of communication information stored on the storage module 22 is an incomplete set of communication information needed to perform the prescribed functionality, such as retrieving prescribed operational information from the vehicle.

However, the first set of communication information may be generic or universal in nature and conformable for use with a wide range of vehicles. In this regard, the first set of communication information may be useful when paired with additional information received from the master database 16. For instance, the diagnostic trouble code P0123 may be used in connection with a wide range of vehicles, and may have different definitions associated therewith, depending on the vehicle. In this regard, the P0123 trouble code may be part of the first set of communication information initially stored on the scan tool 12. However, that information by itself may not be useful, because the corresponding definition is not yet stored on the tool. Therefore, when the specific vehicle is identified, the specific definition associated with that vehicle and the P0123 trouble code may be downloaded as part of the second set of communication information downloaded on to the tool 12.

In order to complete the communication information, the scan tool 12 retrieves vehicle classification information and uploads that information to the database 16. According to one embodiment, the scan tool 12 retrieves an electronic VIN from the vehicle computer 14 and uploads the electronic VIN to the database 16. The low-level communication protocol necessary to retrieve the electronic VIN is a standard communication requiring one of only a handful of communication protocols, which are preloaded onto the VIN retrieval module 24 of the scan tool 12 to allow the scan tool 12 to retrieve the electronic VIN upon establishing communication with the onboard computer 14. Such low-level communication protocols are different from the higher-level communication information included in the first and second sets of communication information, which are collectively used to retrieve operational data from the onboard computer 14, as well as to communicate with vehicle components.

When the electronic VIN is retrieved by the scan tool 12, the VIN is uploaded to the database 16 via the communications module 26. The database 16 includes a VIN decoder 30 for decoding the VIN to determine the year, make, model, and/or engine type of the vehicle 15. Although the VIN decoder 30 is shown in connection with the database 16, it is understood that the VIN decoder 30 may alternatively be integrated into the scan tool 12.

The database 16 identifies the communication information associated with the year, make, model and engine type of the vehicle 15 associated with the VIN received from the tool 12. According to one embodiment, such information is the entirety of the communication information needed by the scan tool 12 to communicate with the onboard computer for performing the desired functionality. In this regard, the database 16 may further identify only that information which is not already stored on the automotive scan tool 12 as the information that must be downloaded to the scan tool 12 to complete the communication information already stored on the scan tool 12. The communication information may then be communicated from the database 16 to the scan tool 12 and stored in the storage module 22.

The communication capabilities of the scan tool 12 may allow the scan tool 12 to be routinely updated with communication information. In this regard, if the vehicle computer 14 is updated with new information, the scan tool 12 may also be updated to communicate with the vehicle computer 14.

Furthermore, the communication capabilities of the scan tool 12 allow a single automotive scan tool 12 to be used with several vehicles. In this regard, the scan tool 12 may be "re-customized" when the scan tool 12 is plugged into a new vehicle. The re-customization may entail deleting the information stored on the scan tool 12 that is specific to the previous vehicle, and retrieving the electronic VIN from the new vehicle. The electronic VIN is communicated to the master database and the communication information associated with the new vehicle is communicated from the master database to the scan tool 12.

It is contemplated that various implementations of the automotive scan tool 12 may include sufficient internal storage capacity to allow the scan tool 12 to store communication information associated with two or more discrete vehicles so as to allow the scan tool 12 to be used with various vehicles without having to be "re-customized" each time the scan tool 12 is plugged into one of the vehicles. In other words, each time the scan tool 12 is plugged into a new vehicle for the first time, the scan tool 12 may undergo the customization process described herein. However, the communication information downloaded from the master database 16 as part of the customization process may be stored on the scan tool 12 and associated with an identifier specific to the associated vehicle (i.e., the electronic VIN). Therefore, when the scan tool 12 is plugged into that vehicle at a later time, the electronic VIN is retrieved and used to identify the communication information stored on the scan tool 12. In this regard, according to one embodiment, before the electronic VIN is uploaded to the master database 16, the scan tool 12 reviews any information already stored on the scan tool 12 to determine whether the communication information associated with that electronic VIN is present on the tool 12. If the communication information is present on the scan tool 12, the information is recalled from the storage module 22 and is used to communicate with the vehicle. If, on the other hand, the communication information is not present on the scan tool 12, the electronic VIN is uploaded to the master database 16 to receive the associated communication information therefrom.

According to one embodiment it is contemplated that communication information may be downloaded to the scan tool 12 on an as-needed basis, depending on the functions to be performed by the scan tool 12. For instance, the scan tool 12 may be initially programmed to retrieve general operational information from the vehicle 15. After that information is analyzed, additional functionality may be desired to focus on a particular system of the vehicle 15. For instance, after analyzing the data, it may be desirable to obtain more detailed information regarding the braking performed by the vehicle 15. Therefore, additional communication information which may be necessary to retrieve the more-detailed braking information may be downloaded from the master database 16 to the scan tool 12.

The foregoing describes a scan tool 12 having a communications module 26 resident on the scan tool 12 and configured to be independently capable of long-range communications with the remote master database 16. However, it is contemplated that in other embodiments of the system 10, the scan tool 10 may rely on the communication capabilities of a smart phone/cell phone to perform the long range communication with remote database 16. In this regard, the communications module 26 on the scan tool 12 may be a short-range communications module, which communicates with the cell phone, which in turn communicates with the master database 16.

Additional modifications and improvements of the present invention may also be apparent to those of ordinary skill in the art. Thus, the particular combination of components and steps described and illustrated herein is intended to represent only certain embodiments of the present invention, and is not intended to serve as limitations of alternative devices and methods within the spirit and scope of the invention.

What is claimed is:

1. A method of customizing an automotive diagnostic device configured to communicate with an onboard vehicle computer, the method comprising the steps of:

storing a plurality of first vehicle command instructions associated with a plurality of vehicles on the automotive diagnostic device, the plurality of first vehicle command instructions being useful to implement a specific function(s) to be executed in relation to one of the plurality of vehicles;

retrieving an electronic vehicle identification number (VIN) from a first vehicle on the automotive diagnostic device;

uploading, from the automotive diagnostic device to a master database, a first signal representative of the retrieved electronic VIN, the master database having stored vehicle command instructions arranged by year, make, and model for the plurality of vehicles;

decoding, at the master database, the electronic VIN to determine the year, make, and model of the first vehicle;

selecting, at the master database, certain ones of a plurality of second vehicle command instructions associated with the first vehicle, the selected second vehicle command instructions being selected independent of any evaluation of any operational data received from the vehicle at the master database; and sending the selected second vehicle command instructions associated with the first vehicle to the automotive diagnostic device, the second vehicle command instructions being operative to identify first vehicle command instructions associated with the first vehicle.

2. The method recited in claim 1, wherein in the uploading step the first signal further includes uploading information representative of the plurality of first vehicle command instructions on the automotive diagnostic device.

3. The method recited in claim 1, further comprising the step of implementing the second vehicle command instructions at the automotive diagnostic device.

4. The method recited in claim 1, wherein the automotive diagnostic device is configured to autonomously generate a request for the electronic VIN in response to establishing a communication link between the diagnostic device and the onboard vehicle computer.

5. The method recited in claim 4, wherein the decoding step is performed autonomously in response to receipt of the electronic VIN from the automotive diagnostic device.

6. The method recited in claim 5, wherein the selecting step is performed autonomously in response to receipt of the electronic VIN from the automotive diagnostic device.

7. The method recited in claim 1, wherein the decoding step further includes determining the engine of the first vehicle.

8. The method recited in claim 1, further comprising the step of compiling the master database of second vehicle command instructions.

9. The method recited in claim 1, wherein the plurality of first vehicle command instructions stored on the automotive diagnostic tool are adapted for retrieving odometer readings from a plurality of vehicles.

10. The method recited in claim 9, the second vehicle command instructions are operative to select first vehicle command instructions for retrieving an odometer reading from the first vehicle.

11. The method recited in claim 1, wherein the selecting step includes selecting certain ones of the plurality of second vehicle command instructions associated with the first vehicle based on the year, make, and model of the first vehicle.

12. The method recited in claim 1, wherein at the master database, the selecting of certain ones of a plurality of second vehicle command instructions associated with the first vehicle is based on an evaluation of the year, make, and model of the first vehicle, independent of any evaluation of any operational data received from the vehicle.

13. A method of customizing an automotive diagnostic device configured to communicate with an onboard vehicle computer, the method comprising the steps of:

storing first vehicle communication information associated with a plurality of vehicles on the automotive diagnostic device, the first vehicle communication information including information enabling specific diagnostic communications between the automotive diagnostic device and the plurality of vehicles;

retrieving an electronic vehicle identification number (VIN) from a first vehicle on the automotive diagnostic device;

uploading, from the automotive diagnostic device to a master database, a first signal representative of the retrieved electronic VIN, the master database having stored vehicle communication information arranged by year, make, and model for the plurality of vehicles;

decoding, at the master database, the electronic VIN to determine the year, make, and model of the first vehicle;

identifying, at the master database, second vehicle communication information stored on the master database associated with the first vehicle based on the year, make, and model of the first vehicle, the identified second vehicle command information being identified independent of any evaluation of any operational data received from the vehicle;

sending the second vehicle communication information to the automotive diagnostic device; and selectively enabling certain of the first vehicle communication information in response to the second vehicle communication information to implement diagnostic communications with the first vehicle.

14. The method recited in claim 13, wherein in the uploading step the first signal further includes uploading information representative of the first vehicle communication information stored on the automotive diagnostic device.

15. The method recited in claim 13, wherein the automotive diagnostic device is configured to autonomously generate a request for the electronic VIN in response to establishing a communication link between the automotive diagnostic device and the onboard vehicle computer.

16. The method recited in claim 15, wherein the decoding step is performed autonomously in response to receipt of the electronic VIN from the automotive diagnostic device.

17. The method recited in claim 15, wherein the identifying step is performed autonomously in response to receipt of the electronic VIN from the automotive diagnostic device.

18. The method recited in claim 13, wherein the decoding step further includes determining the engine of the first vehicle.

19. A system for customizing communication with an onboard vehicle computer, the system comprising:

a master database having stored vehicle command instructions arranged by year, make, and model for a plurality of vehicles; and a diagnostic device having a plurality of vehicle command instruction sets stored thereon, the plurality of vehicle command instruction sets being associated with a plurality of vehicles, each vehicle command instruction set implementing a specific function to be executed in relation to one of the plurality of vehicles;

the diagnostic device being configured to retrieve an electronic vehicle identification number (VIN) from a first vehicle and upload a first signal to the master database, the first signal being representative of the retrieved electronic VIN; and the master database being configured to decode the electronic VIN to determine the year/make/model of the first vehicle to select certain ones of the plurality of vehicle command instructions associated with the first vehicle, and to send a second signal representative of the certain one(s) of the plurality of vehicle command instruction set(s) associated with the first vehicle to the diagnostic device, the second signal being operative to select a vehicle command instruction set useful to implement functions on the diagnostic device in relation to the first vehicle, the master database selecting the plurality of vehicle command instructions associated with the first vehicle independent of evaluation by the master database of any operational data received from the first vehicle.

20. The system recited in claim 19, wherein the plurality of vehicle command instruction sets stored on the diagnostic device include instructions for retrieving operational data from the vehicle.

21. The system recited in claim 20, wherein the operational data includes odometer readings.

22. The system recited in claim 19, wherein the diagnostic device is configured to autonomously retrieve the electronic VIN in response to establishing a communication link between the diagnostic device and the onboard vehicle computer.

23. The system recited in claim 22, wherein the diagnostic device is configured to autonomously upload the first signal in response to receipt of the electronic VIN from the onboard vehicle computer.

* * * * *